United States Patent [19]

Adamek

[11] Patent Number: 4,609,142

[45] Date of Patent: Sep. 2, 1986

[54] RECLOSABLE DISPENSER CARTON AND BLANK THEREFOR

[75] Inventor: David J. Adamek, Minneapolis, Minn.

[73] Assignee: Waldorf Corporation, St. Paul, Minn.

[21] Appl. No.: 722,602

[22] Filed: Apr. 12, 1985

[51] Int. Cl.[4] ..... B65D 5/72

[52] U.S. Cl. ..... 229/17 SC; 206/620; 229/7 SC

[58] Field of Search ..... 229/7 R, 17 R, 37 R, 229/7 SC, 17 SC; 206/813, 607, 611, 626, 620, 621, 628

[56] References Cited

U.S. PATENT DOCUMENTS

| | | | |
|---|---|---|---|
| 2,343,857 | 3/1944 | Morganroth | 229/17 SC |
| 2,983,422 | 5/1961 | Miller, Jr. | 229/17 R |
| 3,819,093 | 6/1974 | Forbes, Jr. | 229/37 R |
| 4,094,456 | 6/1978 | Roccaforte | 229/17 SC |
| 4,138,016 | 2/1979 | Roccaforte | 229/17 SC |
| 4,141,485 | 2/1979 | Lambert | 229/17 SC |

FOREIGN PATENT DOCUMENTS

| | | | |
|---|---|---|---|
| 412695 | 4/1966 | Switzerland | 229/17 SC |
| 356800 | 9/1931 | United Kingdom | 229/17 SC |
| 921524 | 3/1963 | United Kingdom | 229/17 SC |

*Primary Examiner*—George E. Lowrance
*Assistant Examiner*—Gary E. Elkins
*Attorney, Agent, or Firm*—Dorsey & Whitney

[57] ABSTRACT

An improved reclosure carton and blank are provided. The blank uses a minimum of paperboard material in achieving a properly supported top that can easily and repeatedly be opened and closed. The ease of opening the carton is facilitated by pairs of alignment embossments and debossments on portions of adjacent inner and outer first side panels. The top of the carton is supported in its closed condition by top support panel which includes an aperture through which the material stored in the carton can be dispensed. The slide panel then is foldably disposed over the top support panel so as to selectively enable complete closure of the aperture therein. Inner and outer top closure panels then securely close the carton.

11 Claims, 10 Drawing Figures

10
11
12
13
14
15
16
17
18
19
20
21
22
24
25
26
27
28
30
31
33
34
35
36
37
38
39
40
41
42
44
52
54
56
58
60
62
64
65
67
68
72
73
74
75
76
77
78
80
82
83
84
85
91
144
1A
a
b
c

RECLOSABLE DISPENSER CARTON AND BLANK THEREFOR

BACKGROUND OF THE INVENTION

Recloseable dispenser cartons have become increasingly popular for storing and dispensing products that are discrete or granular in nature and that are not likely to be completely used immediately after their initial opening. For example, certain small caliber ammunition, such as 22 cartridges, or BB's would fall into this category in that they are discrete and flowable in nature. Additionally only a few such units generally are used at a time, with the remainder being stored for a subsequent use. Other products that are well suited for storage in recloseable dispenser cartons include certain food products such as cough drops or lozengers or granular detergents.

It is desirable that recloseable cartons utilize a minimum of paperboard material to keep manufacturing costs as low as possible. It is also desirable that the carton be tamper proof or tamper evident, such that any unauthorized opening of the carton prior to its purchase by the consumer will be readily apparent. Recloseable dispenser cartons also should be manufactured to insure proper repeatable operations. Thus, the construction must insure that the recloseable panel is not securely fastened in its closed condition during the manufacturing process. Additionally, the construction must insure that the recloseable panel can not move into a position that would make repeated openings and closings difficult.

The known recloseable dispenser cartons include U.S. Pat. No. 4,094,456 which issued on June 13, 1978 and U.S. Pat. No. 4,138,016 which issued on Feb. 6, 1979. These two patents issued to Harry I. Roccaforte and are assigned to the assignee of the subject invention.

U.S. Pat. No. 4,094,456 shows a recloseable dispenser carton of generally rectangular configuration. The top wall of the carton shown in U.S. Pat. No. 4,094,456 includes a pair of tabs hingedly connected to opposed side walls of the carton. The tabs include apertures which are in register with one another. The outermost tab of the carton in U.S. Pat. No. 4,094,456 further includes a glue flap which is secured in face-to-face relationship with the opposed side wall of the carton. The top wall of the carton shown in U.S. Pat. No. 4,094,456 further includes a closure flap which is articulated to a third side wall of the carton and is slidably disposed between the two apertured tabs. The closure flap can be slid relative to the registered apertures to either block or provide access to the interior of the carton.

Although the carton shown in U.S. Pat. No. 4,094,456 includes many desirable features, it was found that in certain instances the innermost apertured flap and the closure panel could fall inwardly thereby affecting the repeated operation of the closure flap. Additionally, the glue flap articulated to the outermost apertured flap was considered to require too much paperboard material.

U.S. Pat. No. 4,138,016 represents an improvement over the above described patent. More particularly, U.S. Pat. No. 4,138,016 is directed to a generally rectangular carton having a recloseable top. The top wall is constructed to eliminate the external glue flap of U.S. Pat. No. 4,094,456 and to further provide a support to prevent the top panels from falling inwardly. More particularly, the carton of U.S. Pat. No. 4,138,016 includes first through third top flaps having registered apertures therein. The first and third apertured top flaps are articulated to opposed first and third side walls of the carton. The second apertured top flap is articulated to the second side wall of the carton. More particularly the second side wall of the carton is of double panel construction and the second apertured top flap is articulated to the inner of those two panels. The sliding closure flap is disposed in face-to-face contact with the second apertured top flap, and is articulated to the outer panel of the second side wall. The carton of U.S. Pat. No. 4,138,016 is constructed by rotating the second apertured top flap and the sliding closure flap inwardly in advance of the first and third apertured top flaps. The closure flap then can be slid intermediate the respective apertured top flaps. Furthermore, the innermost top flaps prevent the sliding closure flap and the first and third apertured top flaps from falling inwardly relative to the carton.

Despite the many effective features of both U.S. Pat. No. 4,094,456 and U.S. Pat. No. 4,138,016, it is desirable to provide a carton that uses even less paperboard material, and that is even more certain of providing proper initial operation of the sliding closure flap and proper long-term operation thereof.

Accordingly, it is an object of the subject invention to provide an improved recloseable dispensing carton.

It is another object of the subject invention to provide a recloseable dispensing carton that utilizes a lesser amount of paperboard material than the known cartons.

It is an additional object of the subject invention to provide an improved recloseable dispensing carton that substantially prevents any of the top flaps from falling inwardly to the carton.

It is still another object of the subject invention to provide an improved recloseable dispensing carton that substantially prevents the sliding closure panel from being initially and permanently secured in its closed condition.

SUMMARY OF THE INVENTION

The blank of the subject invention includes a rectangular outer first side panel, rectangular rear panel, rectangular second side panel, rectangular front panel, rectangular inner first side panel and rear flap consecutively articulated to one another along parallel fold lines. The inner and outer first side panels and the second side panel are of substantially the same size and shape. Similarly, the rear panel and front panel are substantially identical.

The outer first side panel is further defined by a hinge line extending orthogonal to the articulation between the outer first side panel and the rear panel. The hinge line in the outer first side panel effectively divides the outer first side panel into a base portion and a hinged portion. The hinged portion is defined by an embossed area which substantially prevents any adhesive attachment between the hinged portion of the outer first side panel and any panel adjacent thereto.

The inner first side panel includes a debossed area which is disposed to lie in register with the embossed area of the outer first side panel on the erected carton. An adhesive strip is applied to the inner first side panel. The adhesive extends parallel to the articulation between the inner first side panel and the front panel, and in line with the debossed area. The embossed and debossed areas prevent the respective portions of the outer and inner first side panels from being adhered to one another on the erected carton, thereby allowing the hinged portion of the outer first side panel to rotate freely relative to the base portion thereof.

Generally rectangular bottom flaps are articulated to the outer first side panel, the rear panel, the second side panel, and the front panel respectively along fold lines that are generally collinear with one another. The bottom flaps are dimensioned to be folded into overlapping relationship to enable complete closure of the carton.

A generally rectangular top support panel is articulated to the second side panel along a fold line extending generally parallel to the foldable connection between the second side panel and its respective bottom flap. The top support panel includes a cutout appropriately dimensioned and shaped to enable a proper and efficient pouring of the material to be stored in the carton formed from the blank. As explained further below, the top support panel will be the first inwardly folded panel at the top of the carton, and will function to prevent the other panels at the top of the carton from folding inwardly.

Inner and outer top closure panels are articulated to the rear and front panels respectively along fold lines that are collinear with the foldable connection between the top support panel and the second side panel. The inner and outer top closure panels are generally of the same size and shape. More particularly, the inner and outer top closure panels can be generally rectangular, but preferably include cutout portions at the sides thereof most distant from the top support panel. The inner top closure panel includes a cutout substantially the same size and shape as the cutout on the top support panel, and the cutout is disposed therein to lie in register with the cutout on the top support panel when the carton is erected. The outer top closure panel preferably includes an array of perforations that enable removal of a portion thereof substantially conforming in size and shape to the cutouts in the top support panel. Additionally, the array of perforations in the outer top closure panel is disposed to be in register with the cutouts in the top support panel and inner top closure panel on the carton erected from the blank. The outer top closure panel further can include a cutout adjacent to the array of perforations to facilitate the initial grasping of the area defined by their perforations to effect the removal thereof. This particular construction enables the contents of the carton to be properly sealed, and provide evidence of tampering.

A generally rectangular slide panel is articulated to the hinged portion of the outer first side panel along a fold line that is generally collinear with the fold line between the inner top closure panel and the rear panel. The slide panel extends a distance from the outer first side panel sufficient to enable the slide panel to completely obstruct the apertures in the inner and outer top closure panels and the top support panels.

The blank described herein is not provided with a flap extending from one of the top panels and adapted to overlay either the front or rear panel, as had been the case in U.S. Pat. No. 4,094,456. Additionally, the blank described herein is not provided with a top panel articulated to the inner first side panel, as had been the case with U.S. Pat. No. 4,138,016. Consequently, the blank of the subject invention results in a more efficient use of paperboard material. However, as explained further below, the blank of the subject invention can be erected into a carton that enables efficient repeated opening of the slide panel without any of the top panels falling inwardly into the carton.

The blank of the subject invention is formed into an erected carton by consecutively folding the outer first side panel, the rear panel, the second side panel, the front panel, the inner first side panel and the rear flap about their respective fold lines. More particularly, the inner first side panel is positioned to lie inwardly relative to the outer first side panel. Furthermore, the rear flap articulated to the inner first side panel is positioned to lie in face-to-face contact with a portion of the rear panel. The inner and outer first side panels are adhered to one another along the strip of adhesive described above. However, in view of the respective embossment and debossment on the outer and inner first side panels, the hinge portion of the outer first side panel can not be adhered to the inner first side panel.

The bottom of the carton is efficiently formed by merely rotating the respective bottom flaps about their fold lines to the first side wall, rear wall, second side wall of the carton. The top of the carton then is closed by first rotating the top support panel inwardly into a position where it is substantially orthogonal to the various side walls of the carton. The slide panel then is rotated inwardly about its hinge connection to the outer first side panel to at least partly overlay the top support panel. In this folded condition, the slide panel will completely obstruct the aperture in the top support panel. The inner and outer top closure panels then are consecutively folded inwardly and the outer closure panel is adhered to the inner closure panel. In this completely erected condition, the top support panel prevents the slide panel from falling any substantial amount inwardly. The inner and outer guide panels, on the other hand, securely close the carton and through their adhesive connection further prevent an inward folding of any of the top panels.

The carton can readily be opened by removing the portion of the outer closure panel defined by the array of perforations. This initial opening creates three registered apertures in the top support panel and the inner and outer closure panels respectively. These openings can either be obstructed or unobstructed depending upon the relative position of the slide panel. More particularly, when the hinged portion of the outer first side panel is disposed in face-to-face contact with the inner first side panel the slide panel will completely obstruct the apertures extending through the top of the carton. However, a force can be exerted on the slide panel causing the hinged portion of the outer first side panel to rotate about its articulation to the base portion thereof and angularly away from the inner first side panel. Thus, the slide panel will selectively open the top of the carton enabling the contents thereof to be poured outwardly. The carton then can be securely closed by exerting an appropriate force on the slide panel causing the hinged portion of the outer first side panel to rotate back into its face-to-face relationship to the inner first side panel.

DETAILED DESCRIPTION OF THE PREFERRED EMBODIMENT

Figures 1, 1A:
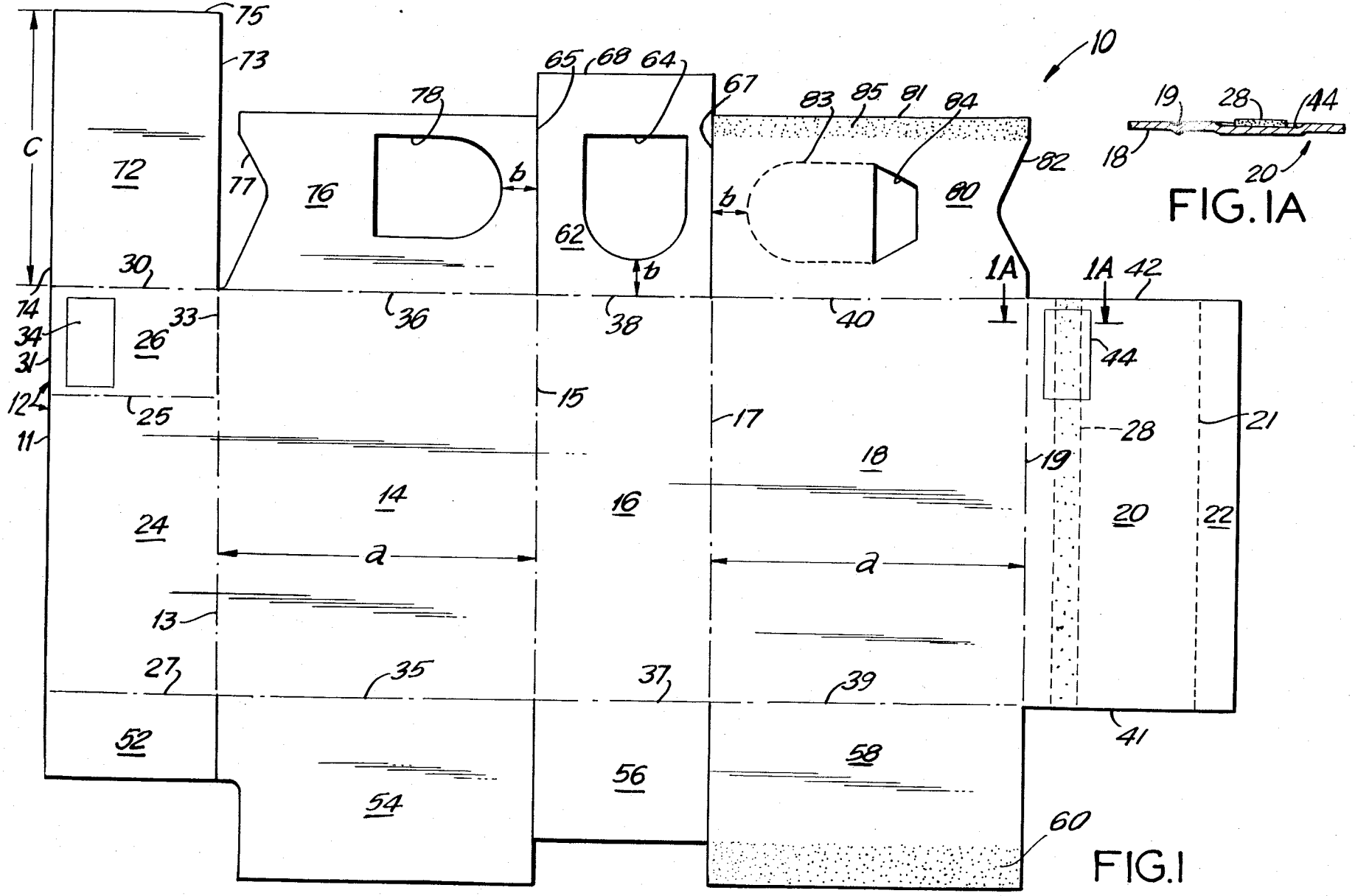
FIG. 1 is a plan view of the blank of the subject invention.
FIG. 1A is a cross-sectional view taken along line 1A—1A in FIG. 1.

The blank of the subject invention is indicated generally by the numeral 10 in FIG. 1. The blank 10 includes rectangular outer first side panel 12, rectangular rear panel 14, rectangular second side panel 16, rectangular front panel 18, rectangular inner first side panel 20 and rear flap 22 which are consecutively articulated to one another along parallel fold line 13, 15, 17, 19 and 21.

The outer first side panel is further defined by edge 11 which is parallel to fold line 13. The outer first side panel 12 includes a base portion 24 and a hinged portion 26 which are articulated to one another along fold line 25 which is orthogonal to fold line 13. The base portion 24 of outer first side panel 12 is further defined by fold line 27.

The hinged portion 26 of outer first side panel 12 is further defined by fold line 30 which is parallel to and equal in length to fold lines 25 and 27. Hinge portion 26 further includes edge 31 which extends collinearly from edge 11 and by cut line 33 which extends collinearly from fold line 13. Edge 31 and cut line 33 are substantially equal in length. The hinge portion 26 also includes a generally rectangular embossment 34 which is parallel and adjacent edge 31. More particularly, the embossment 34 is stamped in blank 10 to extend in an outward direction relative to the final position of blank 10 on the carton erected therefrom.

The rear panel 14 is further defined by cut line 33 and by fold lines 35 and 36, which are equal in length and which extend collinearly from fold lines 27 and 30 respectively. The width of rear panel 14 is indicated by dimension "a".

The second side panel 16 is of substantially the same size and shape as the outer first side panel 12. The second side panel 16 is further defined by fold lines 37 and 38 which are parallel to one another and extend collinearly from fold lines 35 and 36 respectively.

The front panel 18 is substantially identical to the rear panel 14 and is further defined by fold lines 39 and 40, which as shown in FIG. 1, extend collinearly from fold lines 37 and 38 respectively.

The inner first side panel 20 is of substantially the same size and shape as the outer first side panel 12 and the second side panel 16. The inner first side panel 20 is further defined by edges 41 and 42 which extend collinearly from fold lines 39 and 40 respectively. The inner first side panel 20 also includes a debossment 44 which is disposed to be substantially in register with the embossment 34 on the erected carton. As shown in FIG. 1A, the debossment 44 is stamped into the blank 10 so as to extend inwardly on the carton. Thus, the embossment 34 and debossment 44 will be aligned with one another on the erected carton, but will extend in opposite directions. Adhesive strip 28 extends substantially from edge 41 to edge 42, parallel to fold line 19 and in line with debossment 44. Adhesive strip 28 preferably is narrower than debossment 44. When blank 10 is formed into a carton, a portion of adhesive 28 will be adjacent the hinge portion 26 of outer first side panel 12. However, the debossment 44 and embossment 34 insure that the hinge portion 26 of outer first side panel 12 will not be adhered to the inner first side panel 20. The use of a continuous adhesive strip 28 extending substantially between edges 41 and 42 enables the adhesive to be applied much more quickly than any localized application to avoid hinge portion 26.

Bottom flaps 52, 54, 56 and 58 are articulated respectively to the outer first side panel 12, rear panel 14, second side panel 16 and front panel 18 along fold line 27, 35, 37 and 39 respectively. The bottom flaps 52–58 are of generally rectangular construction and are dimensioned to enable complete closure of the bottom of the carton formed from blank 10. Bottom panel 58 is provided with adhesive area 60 which enables secure adhesive attachment to the bottom panel 54.

Top support panel 62 is articulated to the second side panel 16 along fold line 38. The top support panel 62 is of generally rectangular construction and includes cutout 64. The cutout 64 is dimensioned to facilitate pouring of the material to be stored in the carton formed from blank 10. Cutout 64 is spaced from fold line 38 by distance "b". The top support panel 62 is further formed by cut lines 65 and 67 which extend collinearly from fold lines 15 and 17 respectively. Thus, the top support panel 62 is substantially precisely the same width as second side panel 16. As a result, on the carton erected from blank 10 the top support panel 62 will effectively be urged into an erected condition between the front and rear panels 14 and 18. Top support panel 62 is further defined by edge 68 which extends generally parallel to fold line 38. The distance between fold line 38 and edge 68 preferably is equal to at least approximately one-half the length of fold lines 36 and 40. Thus, the top support panel will extend a sufficient distance across the top of the carton formed from blank 10 to support the top of the carton as explained herein.

Slide panel 72 is articulated to the outer first side panel 12 along fold line 30. The slide panel 72 is further defined by edges 73 and 74 which extend collinearly from cut line 33 and edge 31 respectively. Slide panel 72 is further defined by edge 75 which is generally parallel to fold line 30. The distance between edge 75 and fold line 30 is indicated by dimension "c", and is sufficient to enable the slide panel 72 to completely obstruct opening 64 on the carton erected on blank. Stated differently, dimensions "c" plus "b" are greater than dimension "a".

Inner top closure panel 76 is articulated to the rear panel 14 along fold line 36. The inner top closure panel 76 is of generally rectangular configuration but includes a cutout portion 77 which will facilitate the grasping of slide panel 72 on the carton erected from blank 10. Inner top closure panel 76 further includes a cutout 78 substantially identical to the cutout 64 in the top support panel 64. The cutout 78 is configured and disposed to be in register with cutout 64 on the carton erected from blank 10.

Outer top closure panel 80 is articulated to the front panel 18 along fold line 40. The outer top closure panel 80 further includes edge 81 which is generally parallel to fold line 40 and cutout portion 82 which is of generally the same configuration as cutout portion 77. On the carton erected from blank 10, the cutout portion 77 and 82 will be substantially adjacent one another thereby enabling the slide panel 72 to be grasped adjacent fold line 30. The outer top closure panel 80 further includes an array of perforations 83 which have substantially the same size and configuration as cutouts 64 and 78. Outer top closure panel 80 also includes cutout 84 which is disposed adjacent the array of perforations 83. The cutout 84 is generally trapezoidal and is dimensioned to facilitate the insertion of a finger to enable grasping of the area defined by perforations 83. Thus, on the carton erected from blank 10 the area defined by perforations 83 will function as a seal that can easily be severed from the remainder of the outer top closure panel 80.

Blank 10 is erected into the carton 90 illustrated in FIGS. 2 through 8 by rotating the outer first side panel 12, rear panel 14, second side panel 16, front panel 18, inner first side panel 20 and rear flap 22 about their respective foldable connection 13, 15, 17, 19 and 21. Rear flap 22 is disposed interiorly of rear panel 14. Similarly, the inner first side panel 20 is adhered interiorly of the outer first side panel 12 by adhesive strip 28. The embossment and debossment 34 and 44 insure that the hinged portion of the outer first side panel 12 is not adhered to the facing portion of the inner first side panel 20. The bottom flaps 52, 54, 56 and 58 then can be rotated about their respective fold lines 27, 35, 37 and 39 to enable adhesive area 60 on bottom flap 58 to be adhered to bottom flap 54. Thus, an upstanding structure with a securely closed bottom is formed.

The top of the carton 90 is formed by first rotating the top support panel 62 about fold line 38 and into perpendicular alignment with the second side panel 16. The edges 65 and 67 of the top support panel 62 thus are substantially adjacent the fold lines 36 and 40. As a result, the front and rear panels 18 and 14 frictionally hold the top support panel 62 in a plane orthogonal to the second side wall 16. The slide panel 72 then is rotated about fold line 30 into partially overlapping relationship with top support panel 62. More particularly, slide panel 72 is dimensioned to completely overlay the opening 64 in the top support panel 62.

The carton 90 then is securely closed by first rotating the inner top closure panel 76 about fold line 36 so as to cover the slide panel 72. Next, the outer top closure panel 80 is rotated about fold line 40, and adhesive area 85 is activated to secure the outer top closure panel 80 to the inner top closure panel 76.

Figure 2:
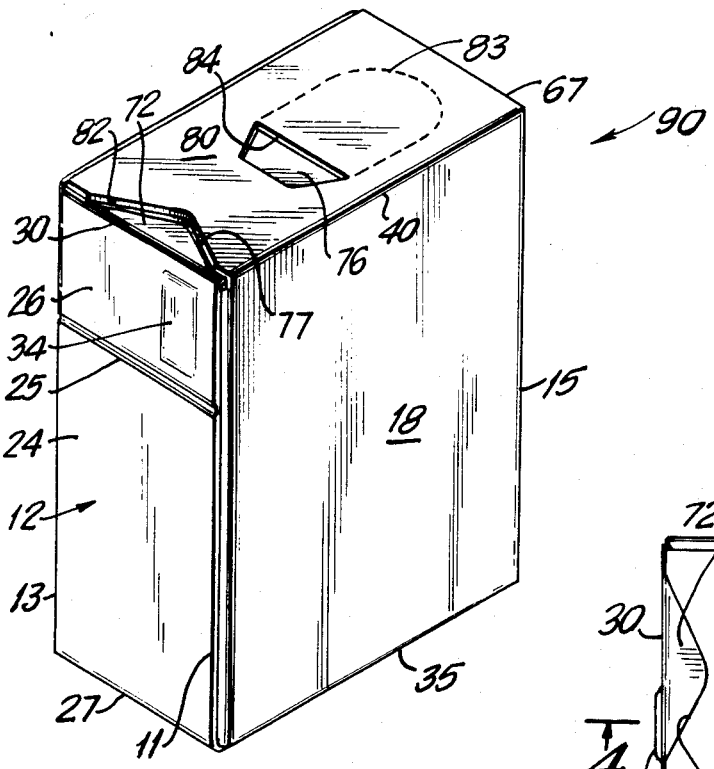
FIG. 2 is a perspective view of the fully erected and closed carton of the subject invention.
Figure 3:
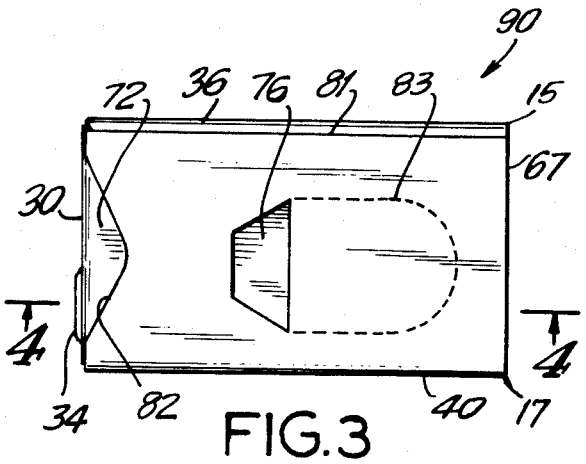
FIG. 3 is a top elevational view of the carton shown in FIG. 2.
Figure 4:
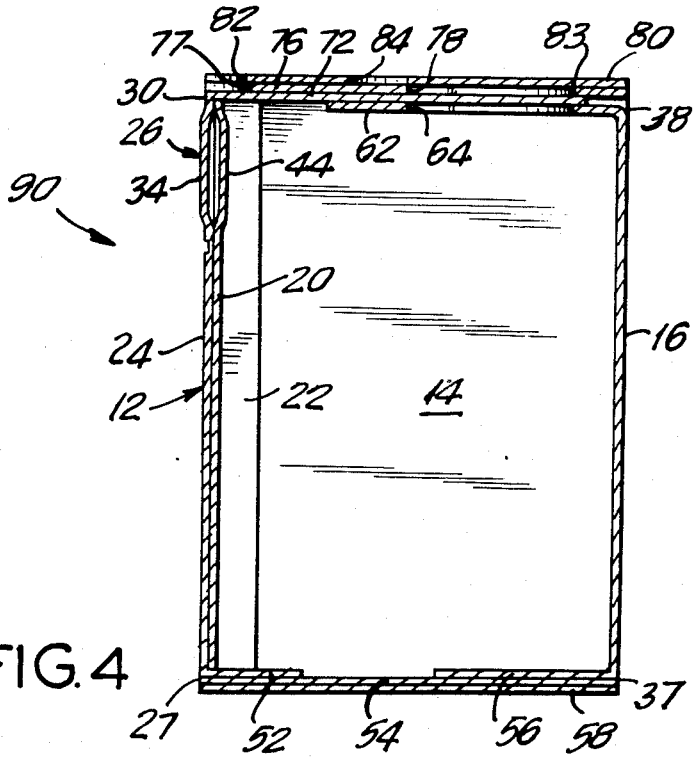
FIG. 4 is a cross-sectional view taken along line 4—4 in FIG. 3.
Figure 5:
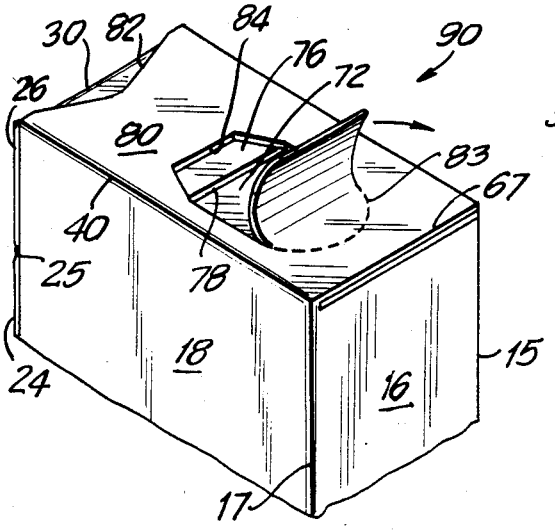
FIG. 5 is a perspective view showing a first stage in the opening of the carton of the subject invention.

It should be noted that in this closed condition the top of the carton 90 is effectively sealed shut as shown most clearly in FIGS. 2 through 4. More particularly, the slide panel 72 completely covers the opening 64 in the top support panel 62. Additionally, the area defined by perforations 83 on the outer top closure panel 80 further covers the openings 64 and 78 in the top support panel 62 and the inner top closure panel 76.

Initial access to the carton is achieved by first removing the portion of the outer top closure panel 80 defined by the perforations 83. This can readily be accomplished by inserting a finger through aperture 84 and pulling on the portion of the outer top closure panel 80 defined by perforations 83. This initial opening is illustrated most clearly in FIG. 5. It should be noted, in this regard, that an initial opening of the carton 90 is readily apparent, thereby giving evidence of tampering with the carton 90 prior to its sale.

Figure 6:
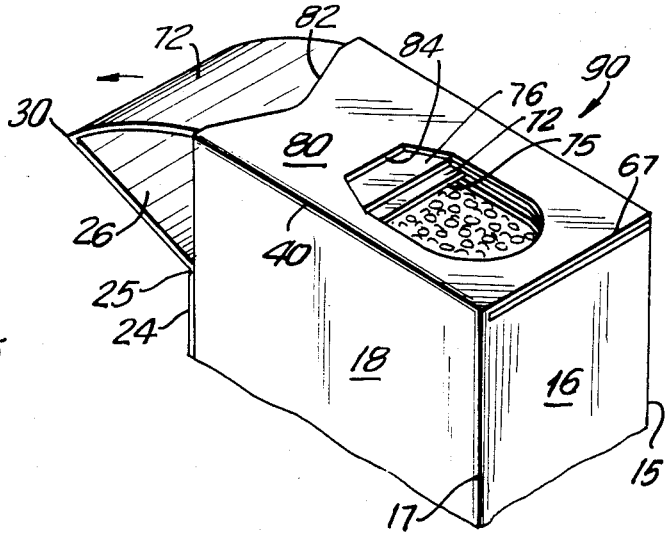
FIG. 6 is a perspective view showing a second stage during the opening of the carton of the subject invention.
Figure 7:
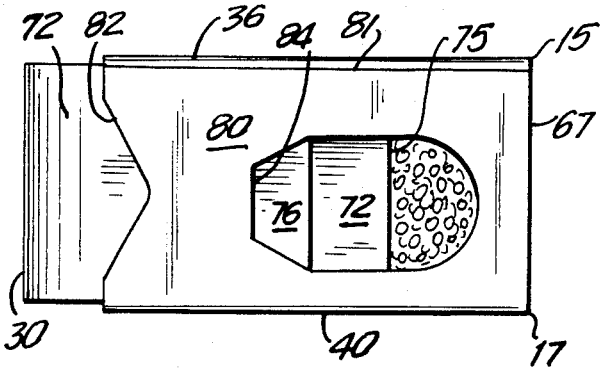
FIG. 7 is a top elevational view of the carton shown in FIG. 6.
Figure 8:
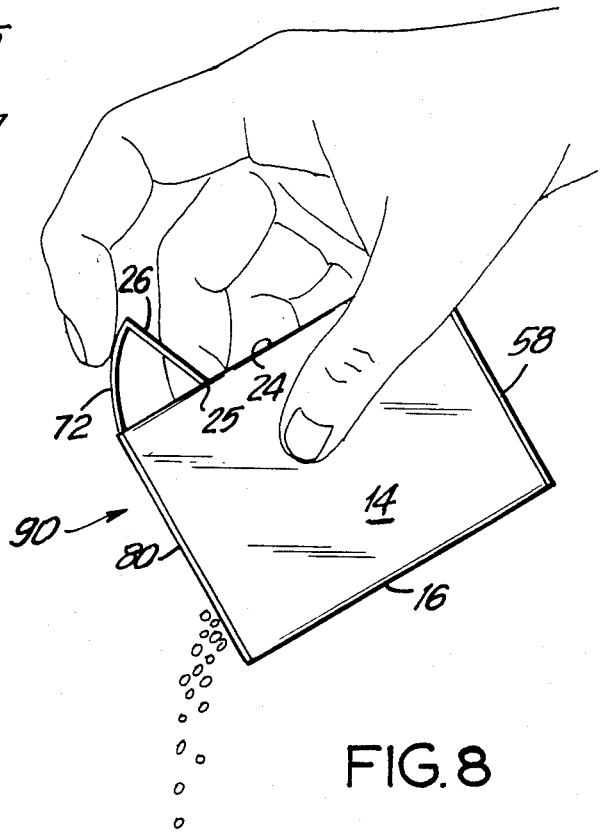
FIG. 8 is a front elevational view showing material being dispensed from the carton of the subject invention.

After removing the portion of top closure panel 80 defined by perforations 83, the carton can be completely opened by slidably moving the slide panel 72 as illustrated in FIG. 6. More particularly, the user of carton 90 can grasp the slide panel 72 adjacent the cutouts 77 and 82 in the inner and outer top closure panels 76 and 78 respectively. This force on the slide panel 72 adjacent the cutouts 77 and 82 will cause a rotational movement of the hinge portion 26 of outer first side panel 12 about fold line 25. A sufficient movement of the slide panel 72 in this manner effectively eliminates the obstruction intermediate the registered apertures 78, 64 and the aperture defined by perforations 83. A portion of the contents of the carton 90 then can be dispensed by merely inverting the carton 90 as illustrated most clearly in FIG. 8. The carton 90 then can be placed in its upright position and closed by exerting an opposite force on the slide panel 72 and/or the hinge portion 26 of outer first side panel 12.

Figure 9:
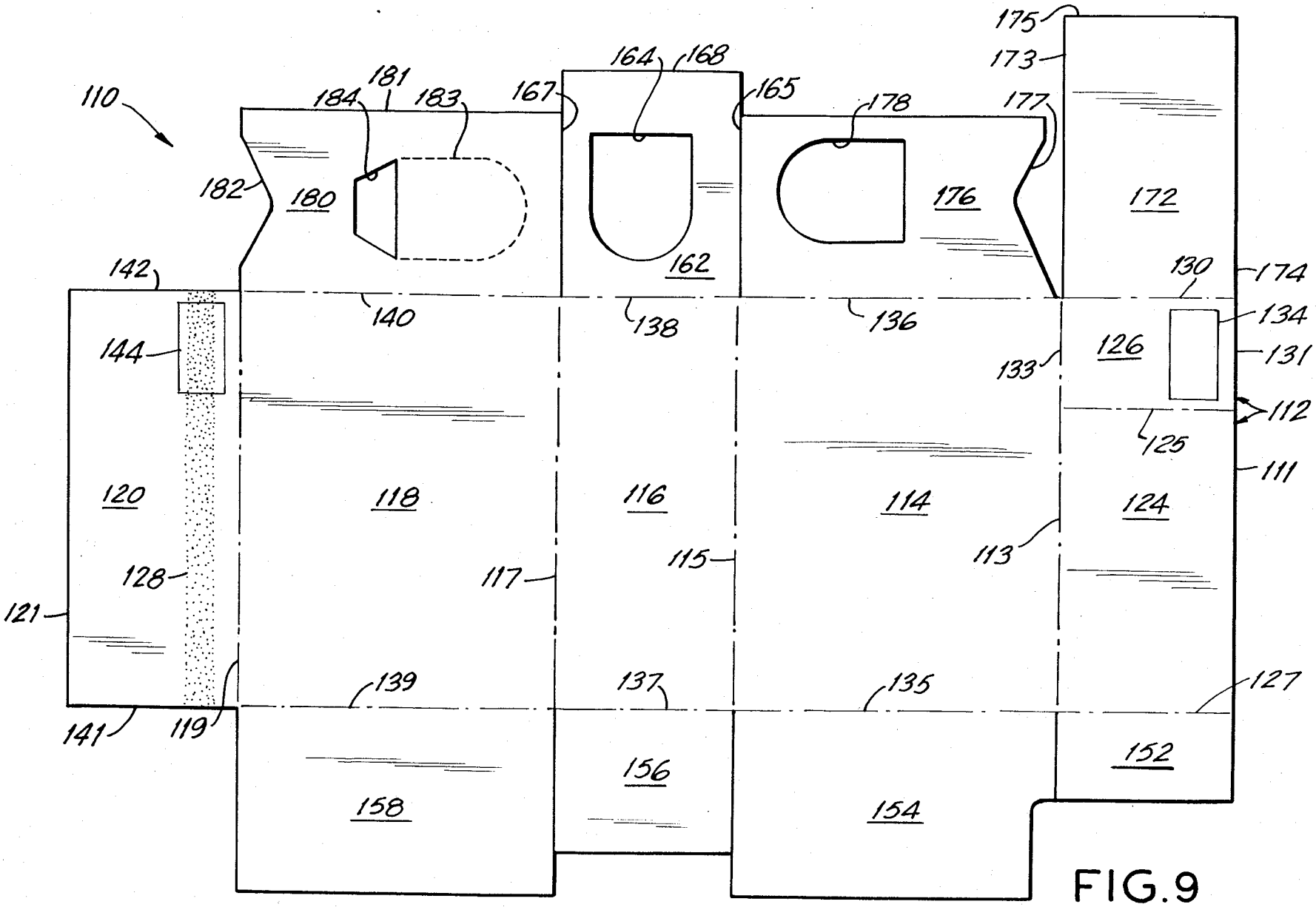
FIG. 9 is a plan view of an alternate embodiment of the blank of the subject invention.

An alternate embodiment of the blank of the subject invention is identified by the numeral 100 in FIG. 9. The blank 100 is similar to the blank 10 shown in FIG. 1 and similar numerals have been used to identify the various panels, fold lines and cut lines throughout. More particularly, the numerals used in FIG. 9 consist of the numeral shown in FIG. 1 preceded by the numeral 1. To help show the structural differences between blank 10 and the blank 100, FIG. 9 illustrates the surface of blank 100 that will define the outside of the carton. In contrast, blank 10 in FIG. 1 had illustrated the surface of the blank 10 that will define the inside of the carton.

The principal difference between the blank 100 in FIG. 9 and the blank 10 in FIG. 1 is that the inner first side panel 120 of blank 100 terminates at edge 121 which extends parallel to the foldable connection 119 between the inner first side panel 120 and the rear panel 118. Thus, the blank 100 is not provided with a rear flap comparable to the rear flap 22 on blank 10. The inner first side panel 120 of blank 100 includes an adhesive strip 128 which extends generally parallel to fold line 119 and substantially in line with the debossment 144. The length of the adhesive area 128 is substantially equal to the distance between fold lines 125 and 127 of base portion 124 of the outer first side panel 112.

The blank 100 is erected in substantially the same manner as blank 10 described above. More particularly, the outer first side panel 112, the front panel 114, the second side panel 116, the rear panel 118 and the inner first side panel 120 are rotated about their respective foldable connections to one another such that the inner first side panel 120 is disposed internal to the outer first side panel 112. The adhesive strip 128 on the inner first side panel 120 is used to adhere the inner and outer first side panels 120 and 112 to one another. The erection of the blank 100 then proceeds as described above with reference to blank 10.

The principal advantage of blank 100 in that a significant amount of paperboard material is saved by not including a glue flap articulated to the inner first side panel 120. The adhesive attachment of the inner first side panel 120 to the outer first side panel 112 along the adhesive strip 128 will be sufficient to retain the carton formed from blank 100 in an erected condition during virtually all conditions of use.

In summary, an improved recloseable carton and blank therefor are provided. The blank utilizes less paperboard material than prior art structures of this type. Additionally, the blank is constructed to substantially prevent the slide panel from falling inwardly into the carton. Furthermore, the blank is constructed to insure unimpeded movement of the hinge portion of the outer first side panel, which in turn enables a proper sliding of the slide panel. The blank for forming the carton includes consecutively articulated outer first side panel, rear panel, second side panel, front panel, inner first side panel and rear flap. The outer first side panel includes a hinge portion which can rotate relative to the remainder of the outer first side panel. A pair of alignable embossments and debossments on the inner and outer first side panels insure that the hinge portion will not be adhered to the adjacent inner first side panel on the erected carton. Bottom flaps are articulated to the outer first side panel, rear panel, second side panel, and front panel respectively. A top support panel including an aperture through which material stored in the carton can be poured is articulated to the second side panel. A slide panel is articulated to the hinge portion of the outer first side panel. Inner and outer top closure flaps are articulated to the rear and front panels respectively. The inner top closure panel includes an aperture that is alignable with the aperture in the top support panel. The outer top closure panel includes a removeable area defined by perforations, and enabling an aperture to be formed therein in alignment with the respective apertures in the top support panel and inner top closure panel. The top of the carton formed from the blank is closed by first folding the top support panel inwardly and then folding the slide panel over the top support panel to block the aperture therein. The inner and outer top closure panels then are rotated inwardly and secured to one another. The carton can initially be opened by removing the area on the outer top closure panel defined by the perforations therein. The carton then can be repeatedly closed and opened by appropriate sliding movements of the slide panel.

While the invention has been described relative to a preferred embodiment, it is obvious that various modifications can be made without departing from the spirit of the invention, which should be limited only by the scope of the appended claims.

What is claimed is:

1. A slide top recloseable dispenser carton comprising:

opposed rectangular front and rear walls disposed in spaced parallel relationship;

first and second opposed side walls disposed in spaced parallel relationship and extending between and connecting said front and rear walls, said first side wall including inner and outer panels disposed in face-to-face contacting relationship, said outer panel of said first side wall including a base portion adhered to the inner panel thereof and a hinged portion rotatable about said base portion thereof toward and away from the inner panel;

a bottom wall connected to and extending between the base portion of said first side wall, said second side wall and said front and rear walls; and a top wall comprising a top support panel articulated to said second side wall and defining the innermost portion of said top wall, said top support panel including an aperture extending therethrough, a slide panel articulated to the hinged portion of the outer panel of said first side wall, said slide panel being disposed in face-to-face contact with said top support panel and covering the aperture therein, and inner and outer top closure panels articulated respectively to said rear and front panels and being folded over said slide panel, said inner top closure panel including an aperture substantially identical to the aperture in said top support panel and disposed in register therewith, said outer top closure panel including an array of perforations defining a removable closure flap in register with the apertures in said inner top closure panel and said top support panel, whereby rotation of said hinged portion of said first side wall enables movement of the slide panel relative to the apertures in the top wall, said top support panel extending substantially the entire distance between said front and rear panels of said carton, whereby said front and rear panels frictionally support said top support panel in a plane generally orthogonal to the first and second side walls of the carton.

2. A carton as in claim 1 wherein the hinged portion of said outer panel or said first side wall includes an outwardly extending embossment, and wherein the inner panel of said first side wall includes an inwardly extending debossment in register with the embossment of the outer panel, whereby said registered embossment and debossment substantially prevent the hinged portion of said outer panel from being adhered to the inner panel of said first side wall.

3. A carton as in claim 2 wherein said base portion of said outer panel is adhered to the inner panel of said first side wall, and wherein the debossment and embossment are substantially in line with the adhesive between said inner and outer panels of said first side wall.

4. A carton as in claim 1 wherein said inner and outer top closure panels include generally registered cutouts at the edges thereof adjacent said first side wall of said carton, said cutouts being dimensioned to facilitate movement of the slide panel relative to said inner and outer top closure panels.

5. A carton as in claim 3 wherein the embossment and debossment define a width between said front and rear panels of said carton greater than the width of the adhesive disposed intermediate the inner and outer panels of said first side wall.

6. A blank for forming a recloseable slide top dispenser carton, said blank comprising:

rectangular outer first side panel, rectangular rear panel, rectangular second side panel, rectangular front panel and rectangular inner first side panel consecutively articulated to one another along parallel fold lines, said outer first side panel, said second side panel and said inner first side panel being of substantially identical size and shape, said front and rear panels being substantially identical, said outer first side panel including a base portion articulated to said rear panel and a hinged portion articulated to said base portion along a fold line extending generally perpendicular to the articulation between said outer first side panel and said rear panel, said hinged portion being separated from said rear panel by a cut line extending collinearly from the articulation between said outer first side panel and said rear panel;

bottom panels articulated respectively to each of said outer first side panel, rear panel, second side panel and front panel;

a top support panel articulated to said second side panel along a fold line extending perpendicular to the articulation between said second side panel and said front and rear panels, said top support panel including an aperture extending therethrough and having a width substantially precisely the same as the width of the second side panel, whereby in the erected carton said front and rear panels can frictionally support said top support panel in a plane generally orthogonal to the first and second side walls of the carton;

a slide panel articulated to the hinge portion of said outer first side panel along a fold line extending perpendicular to the cut line between said hinged portion and said rear panel; and inner and outer closure panels articulated respectively to said rear and front panels along fold lines extending collinearly from the articulation between said top support panel and said second side panel, said inner closure panel including an aperture substantially identical to the aperture in said top support panel, said outer top closure panel including an array of perforations defining a removeable seal substantially identical in shape to the aperture in said top support panel and in register therewith.

7. A blank as in claim 6 wherein said outer closure panel further includes a cutout adjaent said array of perforations therein, said cutout being dimensioned to facilitate grasping of the removeable seal defined by said array of perforations.

8. A blank as in claim 6 wherein said inner and outer closure panels include cutouts defining edges thereof most distant from said top support panel, said cutouts being dimensioned to facilitate grasping of the slide panel on the carton erected from the blank.

9. A blank as in claim 6 wherein said hinged portion of said outer first side panel includes an embossment extending into said blank so as to be outwardly extending on the carton erected from the blank, and wherein said inner first side panel includes a debossment extending into said blank in a direction so as to be inwardly extending on the carton erected from said blank, said embossment and debossment being substantially identical in shape and being disposed to lie in register with one another on the carton erected from the blank.

10. A blank as in claim 9 wherein the base portion of the outer first side panel includes a strip of adhesive extending generally parallel to the articulation between said outer first side panel and said rear panel and being generally in line with the embossment in the hinged portion thereof.

11. A blank as in claim 6 further comprising a rear flap articulated to said inner first side panel along a fold line extending generally parallel to the fold line between said inner first side panel and said front panel.

* * * * *